US005269605A

United States Patent [19]

Nguyen

[11] Patent Number: 5,269,605

[45] Date of Patent: Dec. 14, 1993

[54] THERMOPLASTIC BAG SYSTEM

[75] Inventor: Tai H. Nguyen, Kenner, La.

[73] Assignee: Advance Poly Bag, Inc., Metairie, La.

[21] Appl. No.: 2,196

[22] Filed: Jan. 8, 1993

[51] Int. Cl.[5] ..... B65D 1/34

[52] U.S. Cl. ..... 383/9; 206/554

[58] Field of Search ..... 383/8, 9; 206/554

[56] References Cited

U.S. PATENT DOCUMENTS

| | | | |
|---|---|---|---|
| Re. 33,264 | 6/1990 | Baxley et al. . | |
| 4,476,979 | 10/1984 | Reimann et al. . | |
| 4,676,378 | 6/1987 | Baxley et al. | 383/9 |
| 4,785,938 | 11/1988 | Benoit, Jr. et al. . | |
| 4,811,417 | 3/1989 | Prince et al. . | |
| 4,989,732 | 2/1991 | Smith . | |
| 5,188,235 | 2/1993 | Pierce et al. | 383/9 |

*Primary Examiner*—Joseph Man-Fu Moy
*Attorney, Agent, or Firm*—Joseph T. Regard, Ltd.

[57] ABSTRACT

A bag and system for dispensing configured to minimize the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems. Further, the present system teaches the utilization of reinforced, radially configured handle suppose cuts to provide an opening for allowing the passage of a horizontal handle support member therethrough, the support cuts further configured to provide a medial curved area situated to allow the outer edge of the cut to "ride" upon the handle support member, allowing maximum opening of the bag mouth for easier loading, and easier placement of the bag pack upon the rack. Unlike prior art systems, the radial cut of the present invention is configured to easily spread apart to receive the handle support member, without tabs or folds formed therein. Further, the bag of the present invention also contemplates a unique, non-removable central mouth support piece, wherein there is provided an angled support cut configured for accepting a rack central support piece, the cut configured for providing maximum ease in separation of the dispensed bag from the pack, with nominal crimping of the cut edges during loading of the pack, or tearing of the bag upon dispensing.

16 Claims, 7 Drawing Sheets

THERMOPLASTIC BAG SYSTEM

BACKGROUND OF THE INVENTION

Invention Field

The present invention relates to bag dispensing systems, and particularly to a bag and system for dispensing thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like.

The preferred, exemplary embodiment of the present system teaches a configuration which minimizes the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems.

Further, the present system teaches the utilization of reinforced, radially configured handle support cuts to provide an opening for allowing the passage of a horizontal handle support member therethrough, the support cuts further configured to provide a medial curved section situated to allow the outer edge of the cut to "ride" upon the handle support member, allowing maximum opening of the bag mouth for easier loading, and easier placement of the bag pack upon the rack.

Unlike prior art systems, the radial cut of the present invention is configured to easily spread apart to receive the handle support member, without tabs or folds formed therein.

Further, the bag of the present invention also contemplates a unique, non-removable central mouth support piece, wherein there is provided an angled support cut configured for accepting a rack central support piece, the cut configured to provide maximum ease in separation of the dispensed bag from the pack, with nominal crimping of the cut edges during loading of the pack, or associated tearing of the bag upon dispensing.

GENERAL BACKGROUND DISCUSSION

Although thermoplastic grocery bags have been utilized for over twenty years, only a very small percentage of the hundreds of patents have been embraced by industry to the point of significant commercial acceptance. Designing a thermoplastic bag, particularly with regard low or high density thermoplastic bags, can be a tedious and often unfruitful endeavor, as such material requires a design which allows its utilization as a bag for often heavy contents, which can cause stress fractures and bag failure. Further, the design should be able to be manufactured in an inexpensive, efficient, and consistent manner.

A list of prior patents which may be of interest is presented below

| Patent No. | Inventor(s) | Issue Date |
|---|---|---|
| RE 33,264 | Baxley et al | 06/17/1990 |
| 4,476,979 | Reimann et al | 10/16/1984 |

-continued

| Patent No. | Inventor(s) | Issue Date |
|---|---|---|
| 4,785,938 | Benoit, Jr. et al | 11/22/1988 |
| 4,811,417 | Prince et al | 03/07/1989 |
| 4,989,732 | Smith | 02/05/1991 |

U.S. Pat. No. Re. 33,264 teaches a system wherein there is required a flap in a handle aperture, as well as a detachable tab. It is asserted that the handle aperture/-flap arrangement, when installing a stack of bags on a rack, may unnecessarily complicate the process, as it requires the positioning of the handle members directly in line with the aligned handle apertures to allow passage of the support member and flap therethrough. Further, the detachable tab unnecessarily requires the additional task of disposing the remaining pieces from the dispensed pack.

U.S. Pat. Nos. 4,811,417 and 4,989,732 teach the utilization of a straight, longitudinally situated cut in the handle aperture for engaging the handle support member of the rack. These systems too may have problems, as with low or high density bags, the cuts may tear in longitudinal fashion when loaded fully, causing the bag to fail.

SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

The present invention as configured teaches two types of improvements over prior art systems, namely, relative the central mouth and handle suppose methods, and apparatus for achieving same.

The present invention, unlike much of the prior art, teaches neither the utilization of a straight, longitudinal line, nor an aperture having a flap ('264), rather, the present invention contemplates a fully radially curved cut configured to Spread rather fold upon installation about a rack handle support members; this design provides superior ease in installation when compared to the apenure/flap arrangement, coupled with superior strength over the longitudinal cut arrangement.

Unlike the longitudinal cut, any tear which might occur with regard to the curved cut will occur in the direction of the end lines, that is, laterally, straight to the edge of the outer handle wall, where tearage will cease, as opposed to the longitudinal direction, which could separate the handle upwards, causing roping and failure, or downwards to the body of the bag, causing it to rupture.

In the present invention, in order to maintain the curved handle cut in a spread fashion about the support rod, a bridge ((16) or (17) in FIG. 1) may be provided, strengthening the edges of the medial section, and allowing trouble-free installation of the cut about the handle support member.

The bag of the present invention also contemplates a unique, non-removable central mouth support piece, wherein there is provided an angled support cut configured for accepting a rack central support piece, the cut configured for providing maximum ease in separation of the dispensed bag from the pack, with nominal crimping of the cut edges during loading of the pack, or tearing of the bag upon dispensing.

It is therefore an object of the present invention to provide an improved system for dispensing individual thermoplastic bags or the like.

It is another object of the present invention to provide a radial handle support cut configuration which spreads to allow the passage of a rack handle support member, supporting said handle on the outer edge of said cut.

It is another object of the present invention to provide a non-detachable tab having a support cut configured for accepting the rack support piece in such a fashion as to prevent crimping or folding.

It is still another object of the present invention to provide a bag dispensing system which requires little significant equipment modification, while providing a consistent quality, strong and aesthetically acceptable product.

Lastly, it is an object of the present invention to provide a bag pack which is easily loaded upon a rack, and once dispensed, leaves no residual tabs or pieces thereon.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
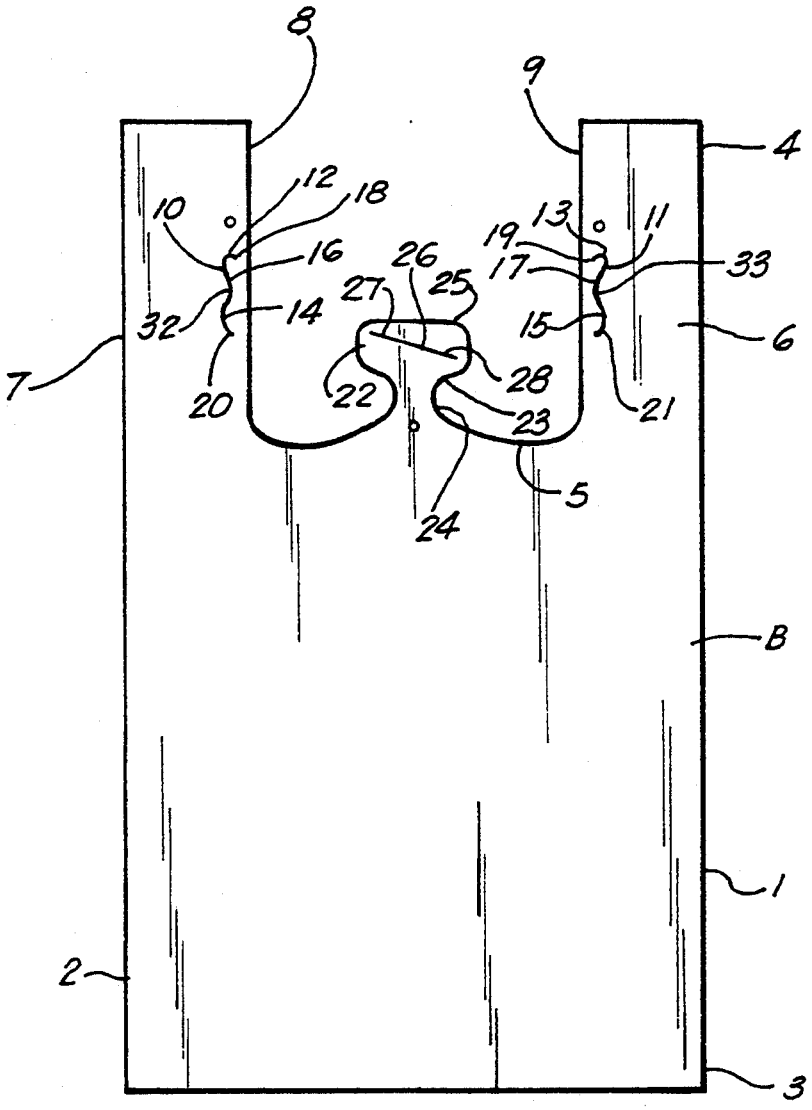
FIG. 1 is a frontal view of the bag and bag of the preferred, exemplary embodiment of the present invention, illustrating the curved handle cut configuration, as well as the angled tab support cut.

As can be seen in FIG. 1, the bag B of the preferred, exemplary embodiment of the present invention, includes first 1 and second 2 sides, a bottom 3 and top 4 ends, and a mouth 5. Emanating from opposing ends of the mouth 5 are first 7 and second 6 handles emanating therefrom, each handle having an inner side edge 8, 9, respectively. Further included in the handles 7, 6, are first and second handle support cuts 10, 11, respectively. Each handle support cut 10, 11, as shown, respectively includes an upper section 12, 13, a lower section 14, 15, and a medial section 32, 33 therebetween. The handle suppose cuts may be formed via cutting die or the like pressed upon and through the bag.

As further shown in FIG. 1, the handle support cuts 10, 11 of the preferred, exemplary embodiment of the present invention respectively includes a bridge piece 16, 17 comprising an uncut portion of the bag traversing the cut between the medial section 32, 33, and the upper section 12, 13, although said bridge piece may alternatively be located between the medial section 32, 33 and the lower section 14, 15 of the support cuts 10, 11, respectively.

Support cuts 10, 11 further include upper 18, 19 and lower 20, 21 ends, respectively. In the preferred embodiment of the present invention, both the upper 18, 19 and lower 20, 21 ends of the bag are configured so as to end in general lateral configuration relative the longitudinal axis of the bags, the ends 18, 20, and 19, 21 configured to discontinue pointing generally in the direction of the inner side edges 8, 9 of their respective handles 7, 6, respectively.

Emanating from the bag mouth 5 is tab 22, having a neck 24, and an upper, bulbous portion 23 having an end 25. Formed and situated at an angled, lateral position in the bulbous portion 23 of tab 22 is the tab support cut 26 having first 27 and second 28 ends.

Figure 2:
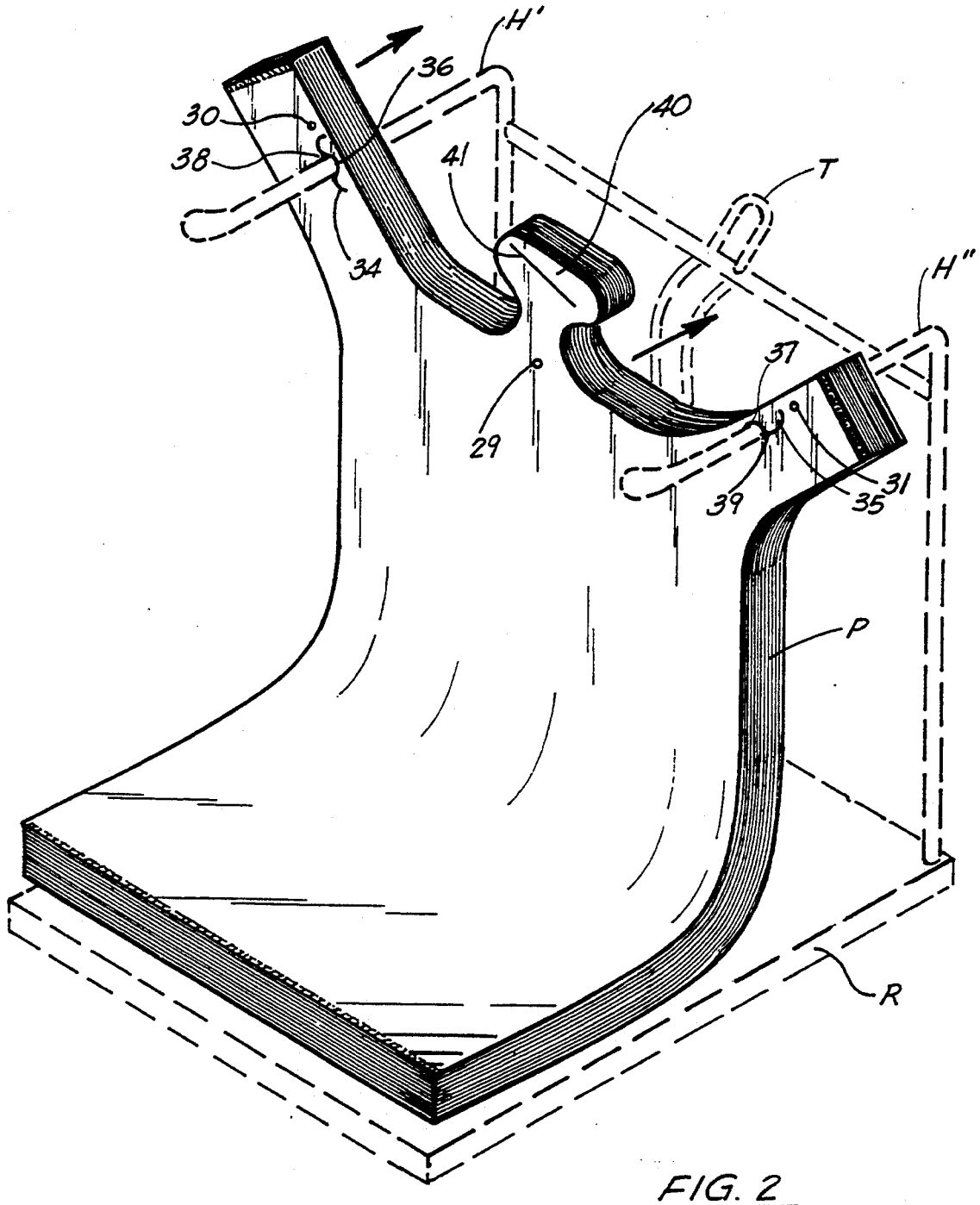
FIG. 2 is an isometric view of the bag pack of FIG. 1, as it is placed upon an exemplary rack, illustrating the communication of the support cuts with the various rack support members.

Referring to FIG. 2 of the drawings, the individual bags of the present invention are held together in a bag pack P via the utilization of a heated or cold punch 29 formed near the tab 40, and punches 30, 31 formed in the handles, in the preferred embodiment, juxtaposed the upper end of the handles and cuts 34, 35, respectively.

As further shown, the bag pack of the present invention may be dispensed upon a rack R having first and second, somewhat horizontally situated handle support members H', H'', and a tab 40 support member T, configured to communicate with handle support cuts 34, 35 and tab cut 41, respectively.

The preferred embodiment of the present invention teaches the forming of a medial section 36, 37 in the handle support cuts 34, 35, configured to spread to allow the passage of handle support member H', H'' therethrough, such that the edge of the handle support cuts communicates with said handle support member.

Bridge 38, 39, may also be formed above the medial sections 36, 37, to facilitate separation of the cuts 34, 35.

Figure 3:
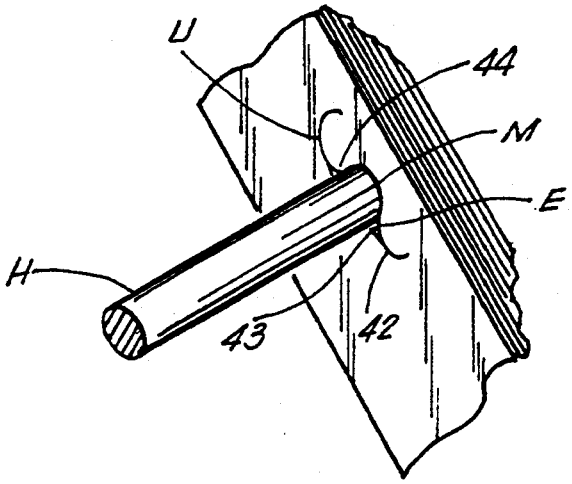
FIG. 3 is a side close up view of the handle support cuts of the present invention, illustrating the communication of the horizontal support bar with the outer, medial edge of the handle support cut, to hold the handles spread apart in a fashion which would not tear said handles, allowing maximum opening of the bag mouth during loading.

FIG. 3 illustrates a close-up view of an exemplary handle support cut 42, wherein the cut is spread to form an opening 43 sufficient to allow passage of handle support member H therethrough. Note the cut bridge 44 rides along the top of the handle support member H, assisting the member H in maintaining its position along the medial M section of the cut 42. The bridge 44 also allows the flexing of the upper U and medial M portions of the cut, allowing spreading of the cut 42 to form the desired opening, while maintaining the integrity of the opening 43 formed, allowing the cut edges to uniformly communicate with the handle H and preventing the folding of the edge E walls as the handle support member H is passed through the opening 43.

Figure 4:
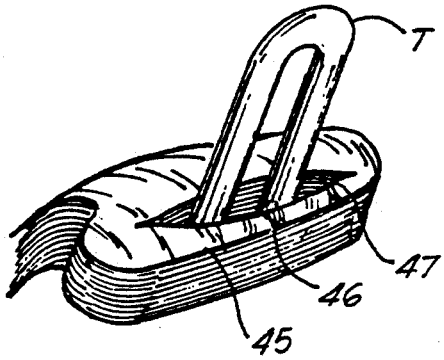
FIG. 4 is an upper, close up view of the angled support cut of the central support piece of the present invention being placed upon the rack medial support piece.
Figure 5:
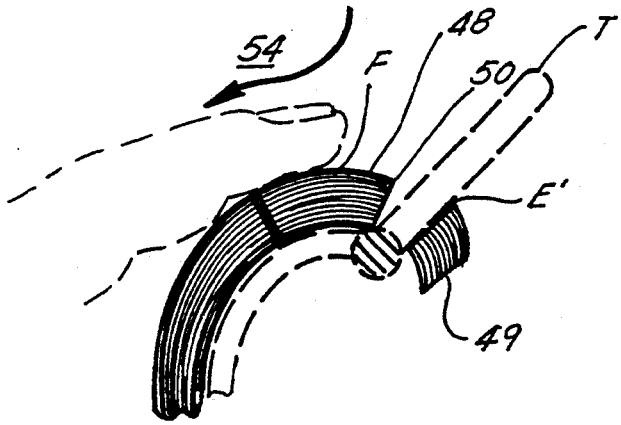
FIG. 5 is an upper, close up view of the invention of FIG. 4, illustrating the full installation of the central support piece of the present invention upon the rack medial support piece.
Figure 7:
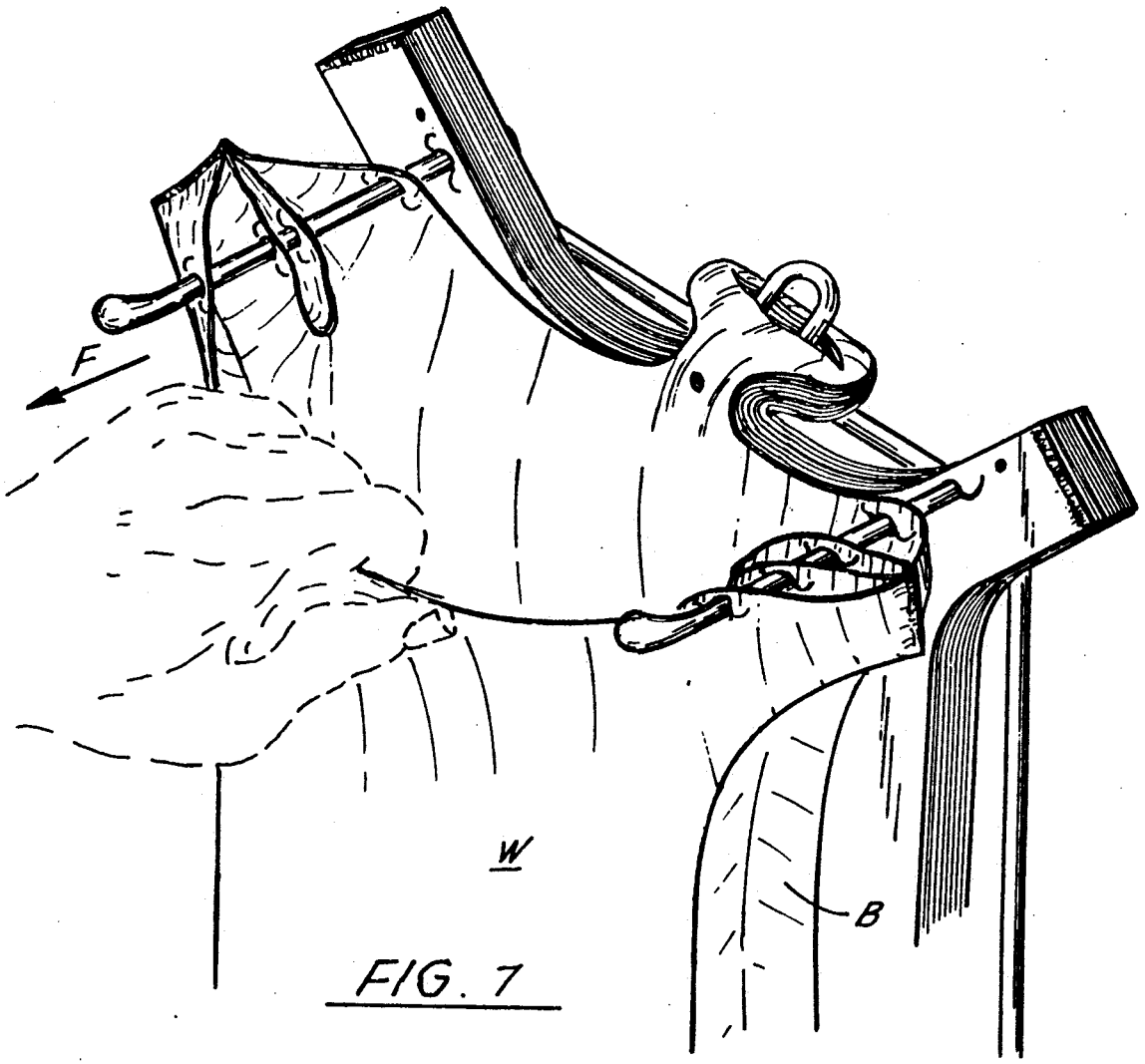
FIG. 7 is an upper, frontal view of the invention of FIG. 5, illustrating removal of the first wall of the central support piece of the present invention, partially dispensing a bag and placing ft into the loading position.

FIG. 4 illustrates the passage of the tab support member T through the opening 47 formed between the edge walls of support cut 46, supporting tab 45. As further illustrated in FIG. 5 cross sectionally, the tab 48 should be slipped over tab support member T via the opening formed by spreading cut 50, such that the end piece 49 of tab 48 is stacked, with the upper edge E of cut 46 in communication with the tab support member T. The angled cut of the tab, as shown in FIG. 1, assists in facilitating this proper positioning with little effort by the user. Referring again to FIG. 4, with the proper positioning of the end piece 49 of tab, in dispensing the bag, the user merely applies light pressure 54 to the face F of the tab and pulling towards him, the user is able to release that tab 48 and associated bag wall from the pack, and referring to FIG. 7, the user, by pulling F the dispensed bag wall toward him, separates the first wall W of the bag B in opened position for loading, while leaving the other bag wall retained with the pack on the rack.

Figure 6:
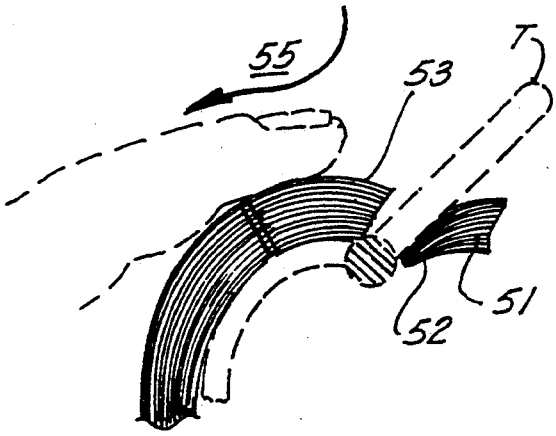
FIG. 6 is an upper, close up view of an exemplary prior art tab, and the crimping associated therewith upon being loaded upon a rack.

An improper tab positioning is illustrated in FIG. 6, wherein the end piece 51 of the tab 53 is crimped 52 relative the tab support member T, and, when the user applies pressure 55 to dispense the tab, the end piece 51 may tear completely off relative the tab 53 and remain in the crimped 52 area, wherein it can later become dislodged and require picking up. This crimping is more likely with a horizontally situated cut, as opposed to the angled cut of the preferred embodiment of the present invention.

Figure 8:
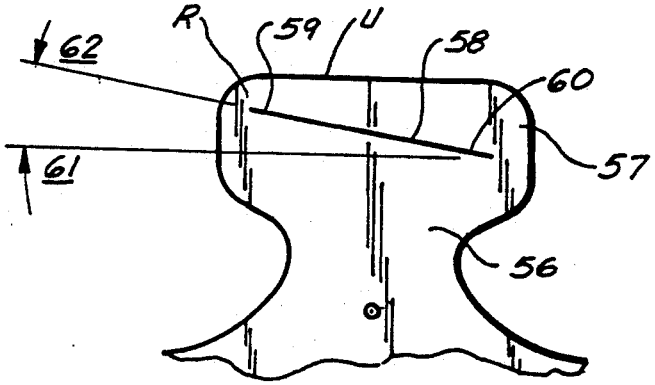
FIG. 8 is a frontal, close up view of the tab of the invention of FIG. 1, illustrating the angled configuration of the cut relative the horizontal.

As shown in FIG. 8, the preferred embodiment of the present invention includes a tab 56 having a bulbous section 57 having formed thereon a generally linear, straight cut 58 having first 59 and second 60 ends, the cut angled 62 generally about 25° relative the horizontal 61 in the exemplary embodiment; the cut should work satisfactory in the range of about 05°-60° (or 170°-120°), however. Further, the first 59 end should be generally about 0.1-0.33 inches from the top U edge of tab 56, in order to provide a satisfactory rupture zone R. As configured, when the user applies pressure to the tab face and pulls toward him, as disclosed in the figures and discussion of FIGS. 4 and 7 supra, the tab support cut 58 should give or rupture at its higher, first end 59 tearing to the outer edge of the tab at rupture zone R, releasing the tab and first bag wall from the rack, while retaining the second bag wall for allowing the opening and loading the bag.

Figure 9:
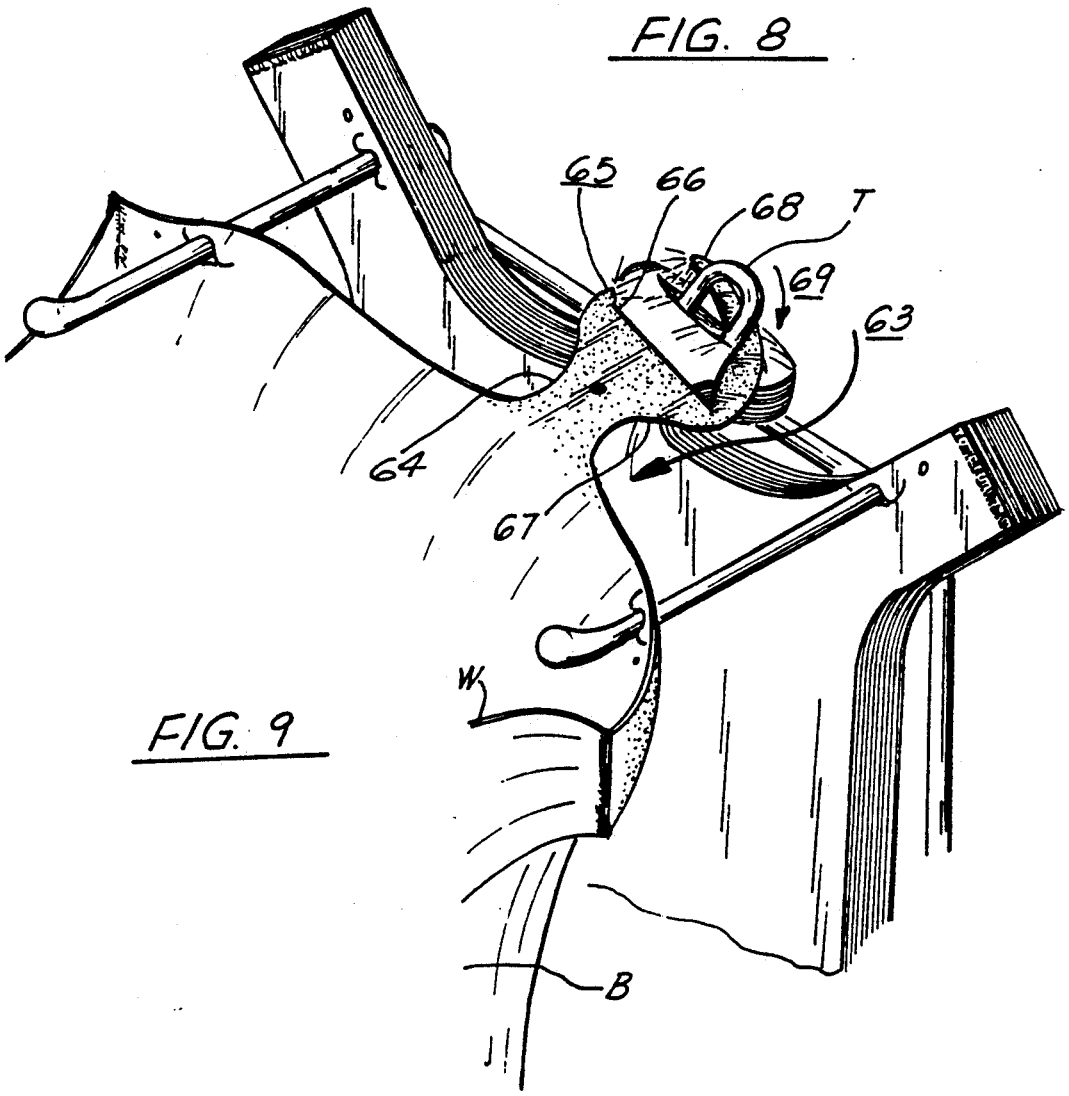
FIG. 9 is an isometric view of the invention of FIG. 1, illustrating removal of the loaded bag from the rack, and its full separation from the bag pack.

Upon loading of the bag, the first wall is again grasped and pulled to remove the loaded bag from the rack. As shown in FIG. 9, once the first wall W' is removed and the bag continues to be pulled toward 63 the user, the tab 64, still engaged to the tab support member T, ruptures 66 at the first end 65 of the cut (59 in FIG. 8) causing the higher, first end of the tab 68 to separate from the lower end 67 on the ruptured side, and allowing the upper end to slip around 69 and away from the tab support member T, and off the rack, thereby completing the dispensing operation.

Figure 10:
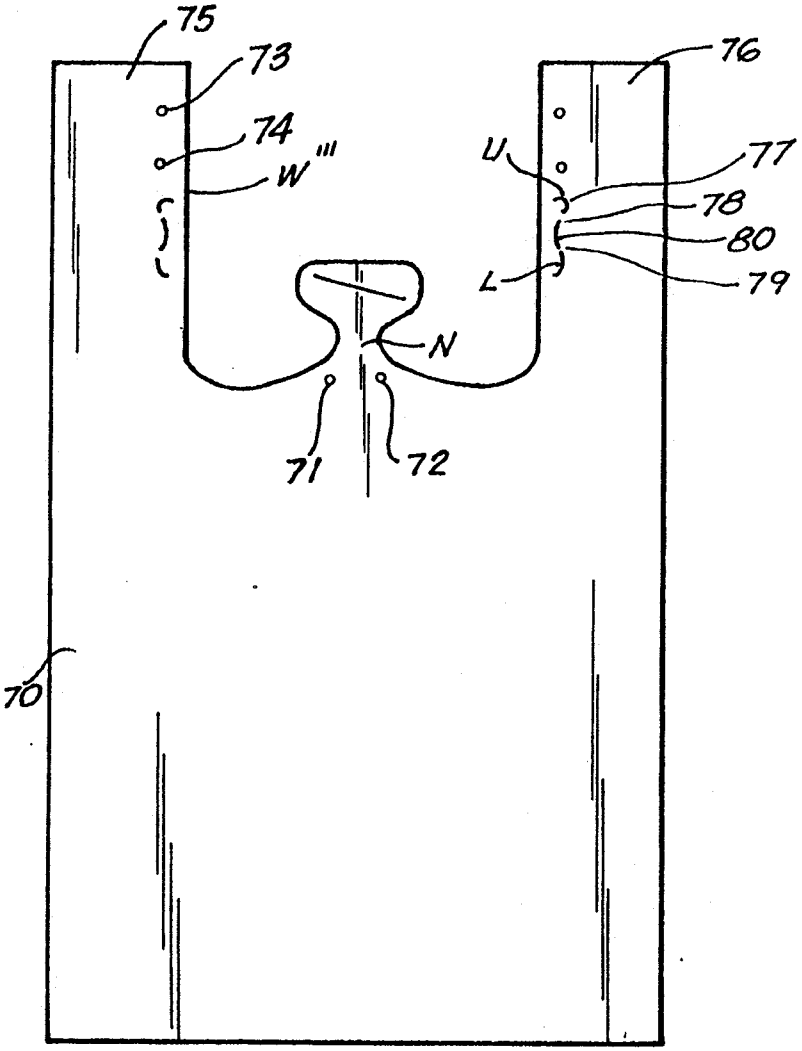
FIG. 10 is a frontal view of an alternative embodiment of the bag of FIG. 1, illustrating the utilization of dual punches on the handles and face to maintain the bags in a pack.

FIG. 10 discloses an alternative embodiment of the present invention, wherein there is utilized a two punch system for retaining the stack of bags in a single pack. As shown, the alternative bag 70 includes first 71 and second 72 punches equilaterally spaced about 0.15-0.65 inches under the mouth of the bag, below the neck area of the tab. This design frees the neck N surface for dispensing, when the user places his or her finger upon the tab or neck area, applying downward pressure and pulling towards the user, releasing the tab from the tab support member, as discussed surpra.

Also shown are first 75 and second 76 handles having first 73 and second 74 punch holes located generally near(0.15-0.45) the inner wall W''' of their respective handles.

As further illustrated, the handle support cut 77 in the alternative design of FIG. 10 includes first 78 and second 79 bridges in said cut, which may provide better spreaded support of the handle cut when supporting the bag pack, the first 78 and second 79 bridges juxtaposed distal ends of the medial section 80 of said cut, the first 78 bridge between the upper U and medial 80 portion of the cut, and the second 79 bridge between the medial 80 and lower L section of said cut 77.

Figure 11:
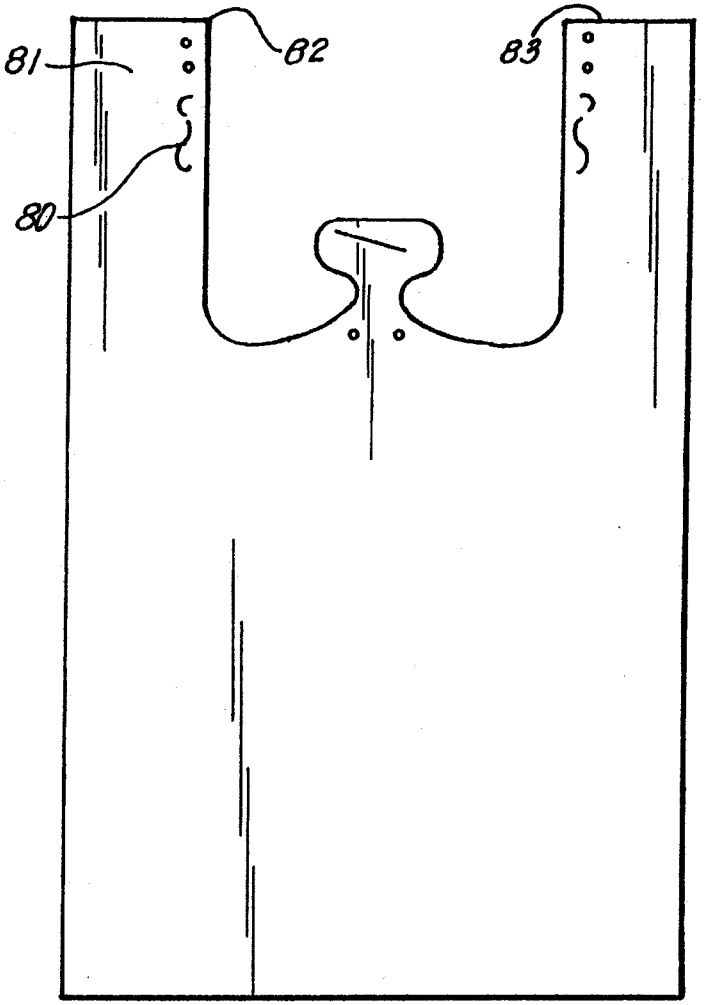
FIG. 11 is as frontal view of another alternative embodiment of the bag of FIG. 1, illustrating the positioning of the handle support cuts closer to the top of the handles, to allow for greater opening of the bag while in loading position upon the rack.

FIG. 11 illustrates still another alternative embodiment of the present invention, wherein the cuts 84 of the handles 82, 83 are moved from the medial area of said handles, as taught in the preferred embodiment, to the upper area 81 of said handles. It has been found that raising the cuts 84 may be preferable when the present system is utilized on some racks, as ft allows for the handles to be spread in a wider fashion when in the loading position than cuts provided in the medial region of the handles.

Figure 12:
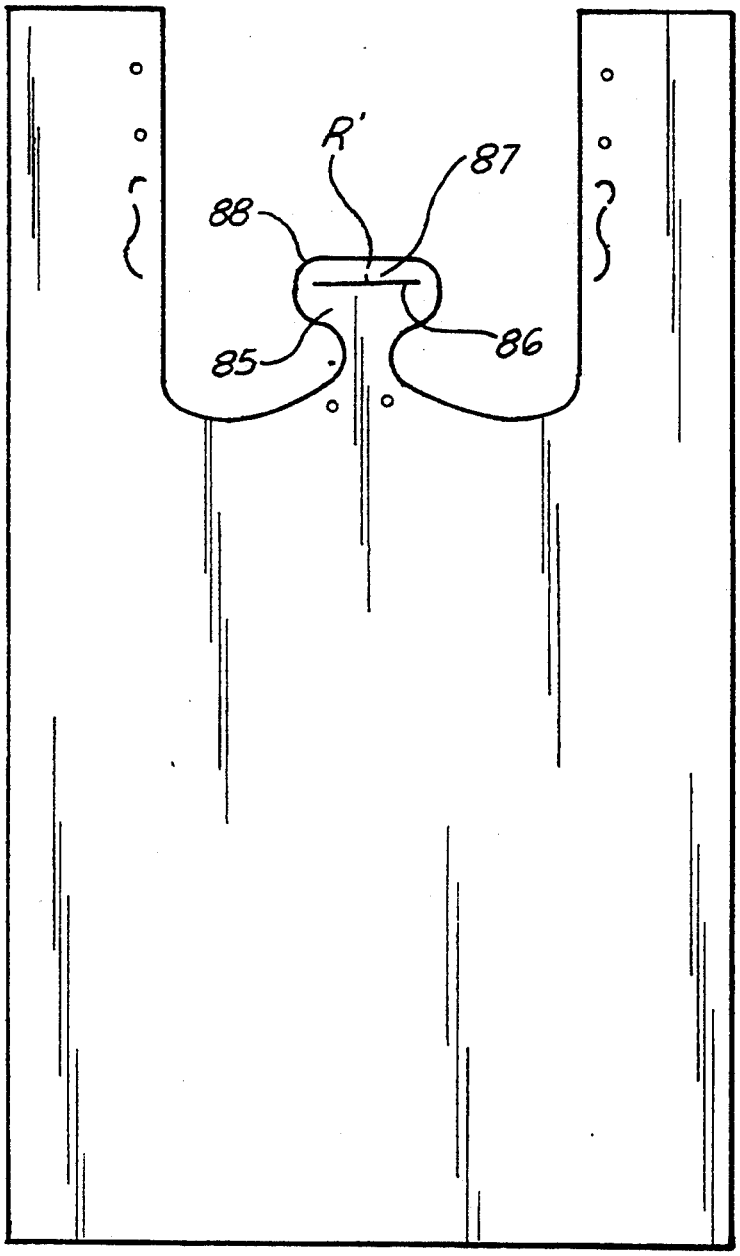
FIG. 12 is a frontal view of still another alternative embodiment of the bag of FIG. 1, illustrating an alternative tab support cut with a medial rupture area, as opposed to the upper, first side rupture area of the cut of the preferred invention.

FIG. 12 teaches still another alternative embodiment of the present invention, wherein there is provided, as opposed the angled tab support cut, a somewhat horizontally arranged support cut 86 in the tab 85, the support cut 86 further including a lateral cut 87 emanating generally from the medial section of the support cut 86 and directed towards the top edge 88 of the tab 85, the cut facilitating a rupture zone R' directly above the medial area of the tab support cut 86 when the bag is dispensed generally in the manner discussed in practicing the preferred embodiment of the present invention, save for the rupture zone has changed. The lateral cut 87 may measure anywhere from 0.015-0.25 inches, depending upon the density of the bag material and resin or other material utilized.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A thermoplastic bag having first and second sides and bottom and top ends, said bag comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10, 11) formed therein, said handle support cuts having an curved cut configuration having upper (18, 19) and lower (20,21) ends directed generally towards the inner side edge (8,9) of said handles (7,6), an upper section (12, 13), a lower section (14, 15), and a medial section (32,33) therebetween, said upper and lower sections each comprising an arcuate cut wherein said arc is formed generally in a direction opposite the inner side edge (8,9) of said handles, and wherein said medial section comprises an arcuate cut wherein said arc is formed generally in a direction towards said inner side edge (8,9) of said handles.

2. The thermoplastic bag of claim 1, wherein said bag has a longitudinal axis along its length, and the upper and lower ends of the handle support cut are configured so as to end in a generally lateral direction relative the longitudinal axis of the bag.

3. The thermoplastic bag of claim 1, wherein there is provided a bridge piece (1 6, 17) comprising an uncut portion of the bag traversing the handle support cut (10,11) between the medial section (32, 33) and upper section (12, 13).

4. The thermoplastic bag of claim 1, wherein there is provided a bridge piece (79) comprising an uncut portion of the bag traversing the handle support cut (77), between the medial section (80) and the lower section (L).

5. A thermoplastic bag having first and second sides and bottom and top ends, said bag comprising:

a bag mouth having opposing ends and a medial area;

a tab (56) having a top U edge, said tab emanating from said bag mouth, said tab comprising a bulbous section (57) having formed therein a generally linear cut (58) having first (59) and second (60) ends, said linear tab cut angled between 05°-60° relative the horizontal, the first end of said cut situated generally near the top U edge of tab.

6. The thermoplastic bag of claim 5, wherein said tab emanates from the medial area of said bag mouth, and the first end of said cut is situated generally about 0.1-0.33 inches from the top U edge of the tab.

7. A thermoplastic bag system for dispensing bags on a rack, the rack having first and second somewhat horizontally situated handle support members, and a tab support member, comprising:

a thermoplastic bag having first and second sides and bottom and top ends, said bag comprising:

a bag mouth having opposing ends and a medial area;

first and second handles emanating from said bag mouth, each of said handles having an upper end, a lower end, an inner side edge, and a medial area therebetween; each of said handles further having a handle support cut formed therein, said handle support cut having an curved cut configuration having upper and lower ends directed generally towards the inner side edge of said handles, an upper section, a lower section, and a medial section therebetween, said upper and lower sections each comprising an arcuate cut wherein said arc is formed generally in a direction opposite the inner side edge of said handles, and wherein said medial section comprises an arcuate cut wherein said arc is formed generally in a direction towards said inner side edge of said handles;

a tab having a top edge, said tab emanating from said bag mouth, said tab comprising a bulbous section having formed therein a generally linear tab cut having first and second ends, said linear tab cut angled between 05°-60° relative the horizontal, the first end of said tab cut situated generally near the top edge of tab;

said tab cut and said handle support members configured to cooperate in supporting said thermoplastic bag pack on said rack, said tab cut configured to accept the tab support member of the rack in such a fashion as to support the bag mouth, said handle support cut of each of said first and second handles configured to spread and accept the first and second handle support members of the rack, respectively.

8. The thermoplastic bag of claim 7, wherein there is provided a bridge piece comprising an uncut portion of the bag traversing the handle support cut, between the medial section and the upper section of said handle support cut.

9. The thermoplastic bag of claim 8, wherein the tab has a neck, and wherein there is provided first and second punches equilaterally spaced under the mouth of the bag, below the neck area of the tab.

10. A thermoplastic bag having first and second sides and bottom and top ends, said bag comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10,11) formed therein, said handle support cuts having an curved cut configuration having upper (18,19) and lower (20,21) ends directed generally towards the inner side edge (8,9) of said handles (7,6), an upper section (12, 13), a lower section (14, 15), and a medial section (32,33) therebetween, said upper and lower sections each comprising an arcuate cut forming an arc, wherein said arc is formed generally in a generally similar direction, and wherein said medial section comprises an arcuate cut forming a medial arc, wherein said medial arc is formed in a direction generally opposite that of the arc of said upper and lower sections.

11. The thermoplastic bag of claim 10, wherein said bag has a longitudinal axis along its length, and the upper and lower ends of the handle support cut are configured so as to end in a generally lateral direction relative the longitudinal axis of the bag.

12. The thermoplastic bag of claim 10, wherein there is provided a bridge piece (16, 17) comprising an uncut portion of the bag traversing the handle support cut(10,11) between the medial section (32, 33) and upper section (12, 13).

13. The method of dispensing individual bags from a bag pack on a rack by a user, the rack having first and second somewhat horizontally situated handle support members, and a tab support member, comprising the steps of:

a. providing a bag pack comprising a plurality of stacked bags, said bag pack further comprising binding means for releasably binding said bags to one another in stacked fashion, forming said pack, each of said bags having first and second sides and bottom and top ends, each of said bags further comprising:

a bag mouth having opposing ends and a medial area;

first and second handles emanating from opposing ends of said bag mouth, each of said handles having an upper end, a lower end, an inner side edge, and a medial area therebetween; each of said handles further having a handle support cut having first and second side edges formed therein, said handle support cut having an curved cut configuration having upper and lower ends directed generally towards the inner side edge of said handles, an upper section, a lower section, and a medial section therebetween, said upper and lower sections each comprising an arcuate cut wherein said arc is formed generally in a direction opposite the inner side edge of said handles, and wherein said medial section comprises an arcuate cut wherein said arc is formed generally in a direction towards said inner side edge of said handles;

a tab having a top edge, said tab emanating from said bag mouth, said tab comprising a bulbous section having formed therein a generally linear tab cut having first and second ends angled between 05°-60° relative the horizontal, the first end of said tab cut situated generally about 0.1-0.33 inches from the top edge of tab, forming a rupture zone;

said tab cut and said handle support members configured to cooperate in supporting said thermoplastic bag pack on said rack, said tab cut configured to accept the tab support member of the rack in such a fashion as to support the bag mouth, said handle support cut of each of said first and second handles configured to spread and accept the first and second handle support members of the rack, respectively, b. spreading the handle support cut of each of said first and second handles or each of said bags in said bag pack to form a handle opening for each of said first and second handles;

c. directing the handle opening of the first handle of each of said bags in said bag pack about the first handle support member, supporting said first handle on the rack;

d. directing the handle opening of the second handle of each of said bags in said bag pack about the second handle support member, supporting said second handle on the rack;

e. directing the tab cut of said tab of each of said bags in said bag pack about the tab support member, supporting said tab on the rack;

f. dispensing a bag, comprising the steps of applying pressure to the first end of the linear tab cut via the tab support member, by directing the tab of the bag to be dispensed in a direction generally toward the user, until said tab ruptures from the first end of the linear tab through the rupture zone, releasing said tab from the tab support member.

14. The method of claim 13, wherein there is provided, in step "a.", the additional step of forming a bridge piece traversing the handle support cut of each of said first and second handles of said bags, said bridge piece juxtaposed the medial section and upper section of the handle support cut.

15. The method of claim 14, wherein there is provided after step "d.", the additional step of allowing the upper and medial sections of said handle support cut of the first handle of each of said bags to adjust, via said bridge piece, so as to allow said first and second side edges, and said bridge piece, of said handle support cut to communicate directly with said first handle support member.

16. The method of claim 15, wherein there is provided after step "d.", the additional step of allowing the upper and medial sections of said handle support cut of the second handle of each of said bags to adjust, via said bridge piece, so as to allow said first and second side edges, and said bridge piece, of said handle support cut to communicate directly with said second handle support member.

* * * * *